US009801423B2

(12) United States Patent
Kyle

(10) Patent No.: US 9,801,423 B2
(45) Date of Patent: Oct. 31, 2017

(54) UNDERGARMENT WITH AN ADJUSTABLE SUPPORT CONFIGURATION

(71) Applicant: 323 Media Group, Philadelphia, PA (US)

(72) Inventor: Jessica Kyle, Philadelphia, PA (US)

(73) Assignee: 323 Media Group, Philadelphia, PA (US)

( * ) Notice: Subject to any disclaimer, the term of this patent is extended or adjusted under 35 U.S.C. 154(b) by 0 days.

(21) Appl. No.: 15/465,755

(22) Filed: Mar. 22, 2017

(65) Prior Publication Data

US 2017/0273379 A1 Sep. 28, 2017

Related U.S. Application Data

(60) Provisional application No. 62/312,218, filed on Mar. 23, 2016.

(51) Int. Cl.
*A41C 3/00* (2006.01)
*A41F 15/00* (2006.01)
*A41C 3/12* (2006.01)

(52) U.S. Cl.
CPC ..... *A41F 15/002* (2013.01); *A41C 3/12* (2013.01)

(58) Field of Classification Search
CPC .... A41C 3/00; A41C 3/02; A41C 3/04; A41C 3/0021; A41C 3/0028; A41C 3/0057; A41C 3/148; A41F 15/00; A41F 15/002; A41F 15/007
USPC ..... 450/16, 63, 64, 70, 52, 57, 85, 88; 2/310, 305
See application file for complete search history.

(56) References Cited

U.S. PATENT DOCUMENTS 1,699,923 A * 1/1929 Rothstein ..... A41F 15/00 450/86
2,063,104 A * 12/1936 Kibbe ..... A41C 3/00 2/325
2,317,664 A * 4/1943 Becker ..... A41C 3/04 450/36
2,423,046 A * 6/1947 Patterson ..... A41F 15/002 2/325
2,753,569 A * 7/1956 Schmalz ..... A41F 15/002 2/323
3,439,682 A * 4/1969 Defru ..... A41C 3/0021 450/36
4,795,400 A * 1/1989 Greenberg ..... A41F 15/007 2/268
5,180,326 A * 1/1993 Williams ..... A41C 3/148 2/73
5,643,043 A * 7/1997 Pflum ..... A41C 3/0057 2/73

(Continued)

*Primary Examiner* — Gloria Hale
(74) *Attorney, Agent, or Firm* — Volpe and Koenig, P.C.

(57) ABSTRACT

The bra adjustment mechanism enables a wearer to modify the fit of the garment. The adjustment mechanism is suitable for bras having a cup portion, a body surround portion and a strap that is connected between the cup and body surround portions. The strap has a free end with a connector for attaching the strap to a body surround portion, which has a plurality of connection positions for to securing the connector to the body surround at a selected position. The body surround preferably includes an elastic segment that provides an expansion area in the body surround for maximum sizing flexibility upon closure of the bra or movement by a wearer.

13 Claims, 5 Drawing Sheets

(56) References Cited

U.S. PATENT DOCUMENTS

| | | | | |
|---|---|---|---|---|
| 6,086,451 | A * | 7/2000 | Fernandes | A41F 15/002 2/67 |
| 6,733,362 | B2 * | 5/2004 | Plew | A41C 3/00 2/67 |
| 7,931,521 | B1 * | 4/2011 | Griffin | A41C 3/0028 2/336 |
| 8,267,740 | B1 * | 9/2012 | Afxentiou | A41C 3/0021 450/63 |
| 8,771,036 | B2 | 7/2014 | Gentry et al. | |
| 9,615,616 | B2 * | 4/2017 | Corrado | A41F 15/002 |
| 2005/0277364 | A1 * | 12/2005 | Redenius | A41C 3/0021 450/41 |
| 2006/0019577 | A1 * | 1/2006 | Gransberry | A41F 15/007 450/86 |
| 2006/0282934 | A1 * | 12/2006 | Fildan | A41F 15/007 2/86 |
| 2010/0210179 | A1 * | 8/2010 | Redenius | A41C 3/0021 450/63 |
| 2010/0298914 | A1 * | 11/2010 | Rosenbaum | A61F 7/00 607/108 |
| 2012/0244782 | A1 * | 9/2012 | Pundyk | A41C 3/0021 450/70 |
| 2012/0302135 | A1 * | 11/2012 | Solotoff | A41C 3/10 450/52 |
| 2013/0084776 | A1 * | 4/2013 | Walsh | A41C 3/0028 450/57 |
| 2013/0135513 | A1 * | 5/2013 | Choi | A61B 5/0077 348/335 |
| 2015/0004877 | A1 | 1/2015 | Bailey et al. | |
| 2015/0093966 | A1 * | 4/2015 | Solotoff | A41C 3/10 450/52 |
| 2017/0027241 | A1 * | 2/2017 | Solotoff | A41C 3/0028 |
| 2017/0095009 | A1 * | 4/2017 | Solotoff | A41C 3/0028 |

* cited by examiner

Prior Art

UNDERGARMENT WITH AN ADJUSTABLE SUPPORT CONFIGURATION

CROSS REFERENCE TO RELATED APPLICATION

This application claims priority to U.S. Application No. 62/312,218, filed on Mar. 23, 2016, which is incorporated herein as if fully set forth.

FIELD OF INVENTION

The invention relates generally to garments that include mating straps that enable a wearer to size the garment. The invention relates more particularly to support undergarment and most particularly to brassieres or bras.

BACKGROUND

Bras are common undergarments worn to support and position the wearer's breast. As commonly sold, a bra of a certain size, such as 34, 36 and etc., will have a body that includes front cup portions for the breasts and body surrounding portions that encircle the wearer's body and generally connect in the back to close the garment. Many bras have several positions were the closing connection can be made to adjust the length of the surrounding portion. Between the cups and connecting portions there are typically straps that go over the wearer's shoulders. Many of these over the shoulders straps have a slide fastener that allows a wearer to adjust the strap's length. Because most bras are sold by a circumferential measure, the body surround portions, and a cup size determined by the breast, the currently available bras are often ill fitting because of the manner in which they are offered. In other words, all wearers of a certain cup size are not necessary of the same body size or type. Accordingly, there is a need for an adjustment mechanism that will accommodate the various body shapes but not require individualized bras to meet the multiple variations.

SUMMARY

The present invention provides a bra with increase adjustability without requiring undesirable changes in the general configuration of the currently common bra structure.

DETAILED DESCRIPTION OF THE PREFERRED EMBODIMENT

Figure 1:
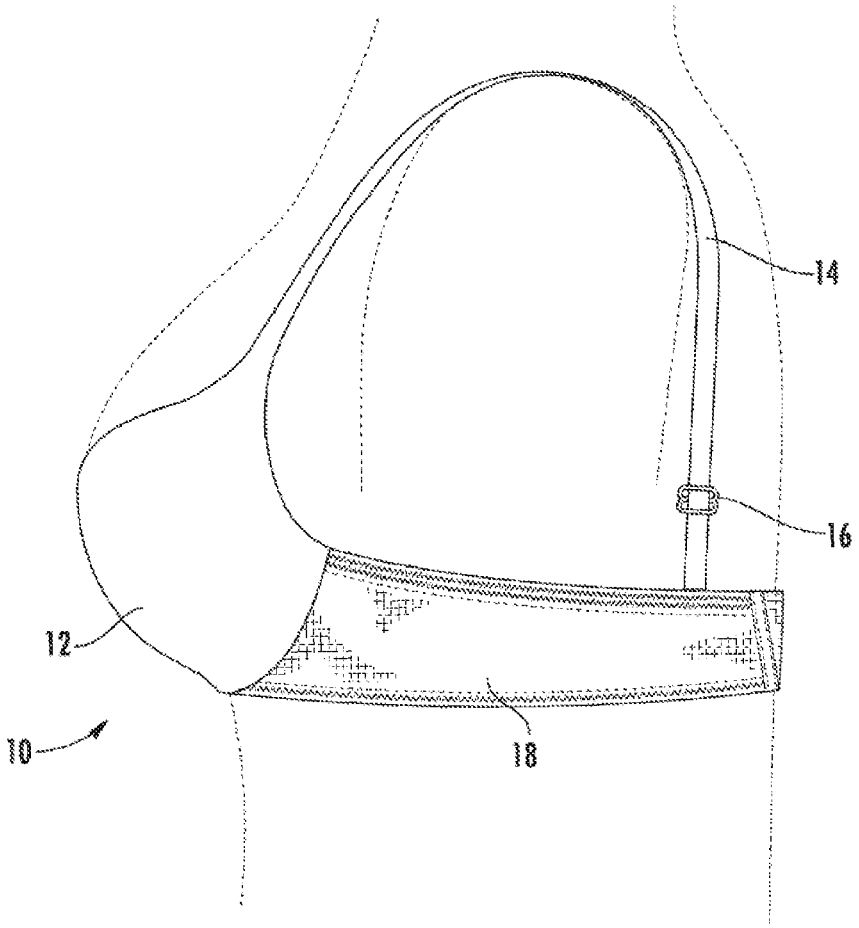
FIG. 1 illustrates a common bra structure and the broken circle locates the preferred area for placement of the present invention.

FIG. 1 illustrates a bra 10 having a cup portion 12, a strap 14, a strap adjustment clip and a body surrounding portion 18. In some bras, the body surround portion is in two halves that connect at a wearer's back, in some bras, the surround portion is continuous and a wearer makes the connection between the cup portions, in still other bras, the bras is a pull on and there is no connecting of surround portions. The present invention applies to any of the aforementioned bras and is not dependent on any surround connection.

In FIGS. 2 through 7, the adjustment is illustrated for a single cup strap, but it is preferred that both strap include an adjustment mechanism.

Figure 2:
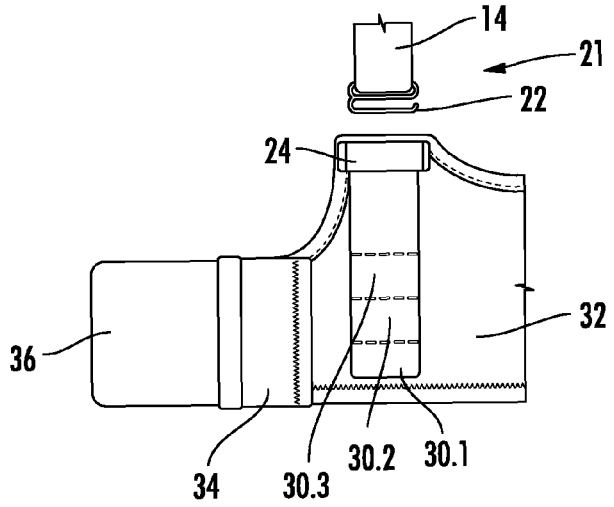
FIGS. 2 through 4 illustrate illustrated the adjustment of the shoulder straps according to the present invention; and, FIG. 5 is an enlarged illustration of the multiple adjustment locations.
Figure 3:
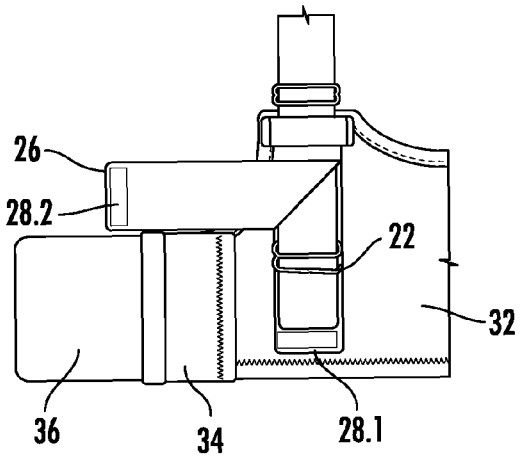
Figure 4:
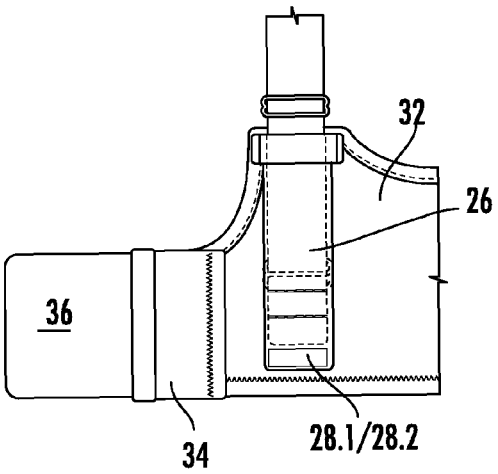
Figure 5:
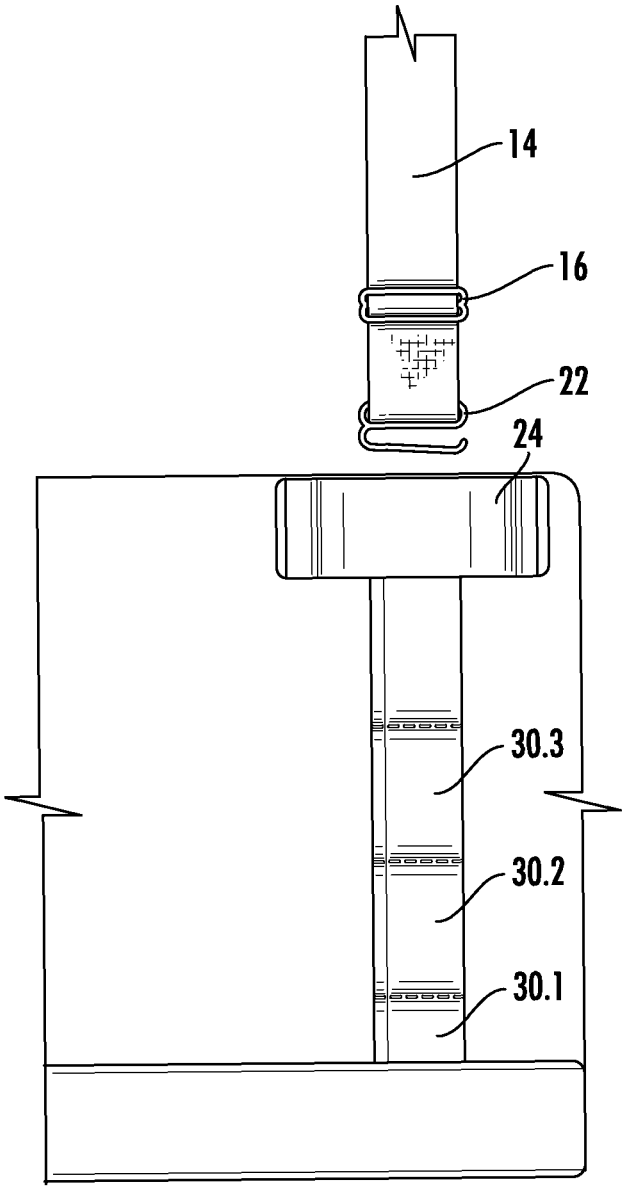

With reference to FIGS. 2 through 4, the shoulder strap 14 is connected to the front or cup portion 12 of the bra and has a second, free end 21 that includes a "G" hook 22. The free end 21 of strap 14 passes through the guide loop 24 and connects to one of a multiple of pocket like loop structures 30.1, 30.2, and 30.3.

The body surround 32 preferably includes an elastic segment 34 that provides an expansion area in the body surround for maximum sizing flexibility upon closure of the bra or movement by a wearer. The inside surface of closure half 36, not shown, has a selected half of a closing element, such as hook and eye or hook and loop fasteners, that joins a mating closing element on the other end of the bra. Although one elastic segment 34 will be sufficient, it is generally preferred to have elastic segments on both halves to provide a more balanced feeling to the wearer.

Still with reference to FIGS. 2 to 4, the free end 21 of strap 20 is passes through guide loop 24 and the "G" hook 22 is inserted in one of the locations 30.1, 30.2, 30.3 that are formed in adjustment strip. Depending on the location selected, the strap 14 will be shortened or lengthened. In addition to present adjustment mechanism, the bra may have a sliding adjuster 23 as is known in the art.

Figure 6:
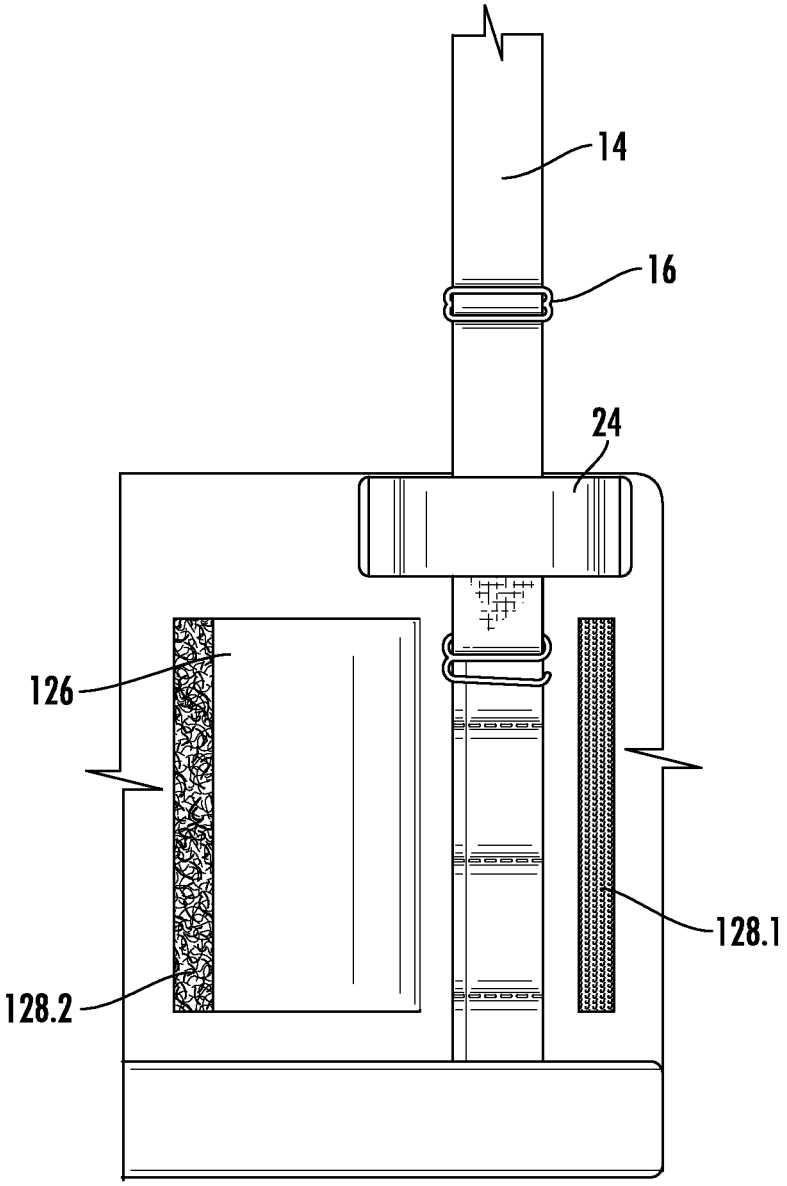
FIGS. 6 and 7 illustrate an alternative comfort closure for covering the adjustment locations.
Figure 7:
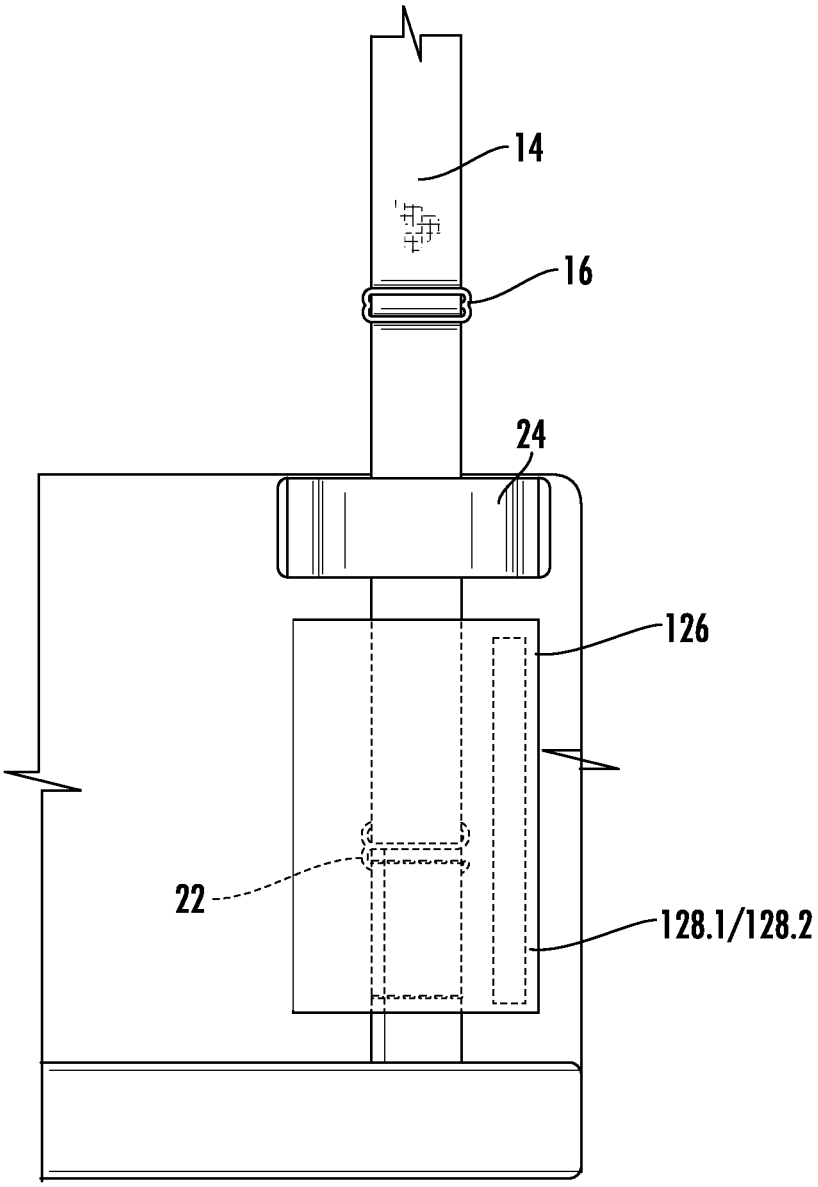

With reference to FIG. 3, one form of a comfort closure 26 to cover the "G" hook 22 is illustrated. In this configuration the comfort cover 26 depends from the guide 24 and is held in place by respective hook and eye or hook and loop fasteners 28.1 and 28.2. FIG. 4 illustrates the closed position for cover 26. With reference to FIGS. 6 and 7, an alternative comfort closure 126 is illustrated. In this configuration, the comfort closure is a flap sown to the body surround 32 and is closed by respective hook and eye or hook and loop fasteners 128.1 and 128.2. Depending on the material of the surround 32, a single fastener that couples to the material may be sufficient to hold the comfort closure in the desired location.

What is claimed is:

1. A bra having a cup portion, a body surround portion and a shoulder strap that is connected between the cup and body surround portions, wherein the shoulder strap has at least one free end that includes a connector, and the body surround portion includes at least one strip that defines a plurality of connection locations that are configured to mate with the connector and secure the free end of the shoulder strap to the body surround; and a guide that aligns the free end of the shoulder strap relative to the plurality of connection locations.

2. The bra of claim 1 wherein the body surround includes at least one elastic portion.

3. The bra of claim 1 further comprising a comfort closure that depends from the guide.

4. The bra of claim 1 further comprising a comfort closure that overlies the plurality of connection locations.

5. The bra of claim 4 wherein the comfort closure is connected to the body surround.

6. An adjustment mechanism for a bra having a cup portion, a body surround portion and a shoulder strap that is connected between the cup and body surround portions and has at least one free end of the shoulder strap secured to a connector, the adjustment mechanism comprising:

a plurality of connection structures that are defined on the body surround portion and are configured to secure the connector to the body surround at a selected one of the plurality of connection structures; and a guide on the body surround portion that aligns the free end of the shoulder strap relative to the plurality of connection structures.

7. The adjustment mechanism of claim 6 wherein the body surround includes at least one elastic portion.

8. The adjustment mechanism of claim 6 further comprising a comfort closure that depends from the guide.

9. The adjustment mechanism of claim 6 further comprising a comfort closure that overlies the plurality of connection structures.

10. The adjustment mechanism of claim 9 wherein the comfort closure is connected to the body surround portion.

11. The bra of claim 1 wherein the guide is above and spaced from each of the plurality of connection locations.

12. A bra having a cup portion, a body surround portion and a shoulder strap that is connected between the cup and body surround portions and a free end that includes a shoulder strap connector, wherein the body surround portion includes a plurality of connecting points, that are configured to mate with the shoulder strap connector and secure the free end of the shoulder strap to the body surround at a selected one of the plurality of connecting points, and a comfort closure that is positioned to overlie the plurality of connecting points that is fixed to the body surround portion at a first end and has a distal end that includes a fastener for attachment to the body surround portion.

13. The bra of claim 12 further comprising: a guide that aligns the shoulder strap with the plurality of connecting points.

* * * * *